United States Patent [19]

Wellekens

[11] 3,933,380

[45] Jan. 20, 1976

[54] LOCK MECHANISM

[76] Inventor: John F. Wellekens, 51 E. 42nd St., New York, N.Y. 10017

[22] Filed: Oct. 21, 1974

[21] Appl. No.: 516,640

[52] U.S. Cl. ..... 292/175; 70/143; 292/169.13

[51] Int. Cl.[2] ..... E05C 1/10; E05B 55/00

[58] Field of Search ..... 70/143; 292/169.13, 332, 292/333, 175

[56] References Cited

UNITED STATES PATENTS

| | | | |
|---|---|---|---|
| 1,191,539 | 7/1916 | Schoell | 70/107 |
| 1,557,374 | 10/1925 | Soley | 70/143 |

*Primary Examiner*—Albert G. Craig, Jr.
*Attorney, Agent, or Firm*—Harry Radzinsky

[57] ABSTRACT

A lock mechanism having a casing through which a spring-biased bolt is slidably movable, the bolt having an end which can be normally extended for a relatively short distance beyond the casing to assume a so-called "latching" position. A slidable sensing bar is arranged alongside of the bolt and in sliding contact therewith and the sensing bar is spring-biased so that it normally projects out of the casing for a distance co-extensive with the bolt while the bolt is either retracted or is in its latching position. A roller carried by the bolt is interposed between the bolt and the sensing bar and is confined in the casing in such a manner that while it rests upon a cam portion of the sensing bar, its bodily movement in the casing will be limited by a stop located therein and the bolt and the sensing bar will be maintained together in either the fully retracted position of the bolt or in its latching position. When the door on which the lock is fitted is moved to closing position, or is slammed shut, the sensing bar, contacting the striking plate on the door frame, will be held against advancement and the bolt entering the bolt opening in the striking plate, will be advanced by its spring bias to move the roller away from the stop, causing the bolt to be extended beyond its latching position to a locking or "dead bolt" position.

4 Claims, 3 Drawing Figures

LOCK MECHANISM

The present invention relates to a lock mechanism and more particularly to mechanism employed in a lock for use upon a door or similar closure, an example of such mechanism being shown and described in my U.S. Pat. No. 3,872,697 dated Mar. 25, 1975. The present invention is an improvement over the construction disclosed in said application.

It is a primary object of the invention to provide a simple and effective means to automatically project the bolt of a lock upon the closing or slamming of a door to an advanced or fully projected condition or to a so-called dead bolt position.

Figure 1:
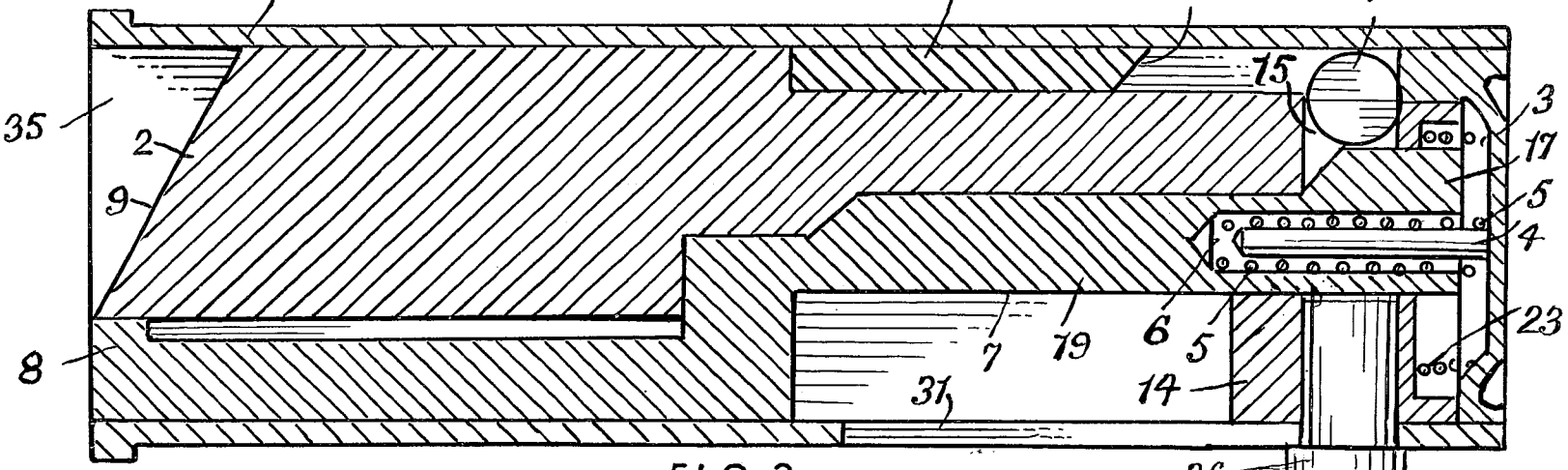
Figure 2:
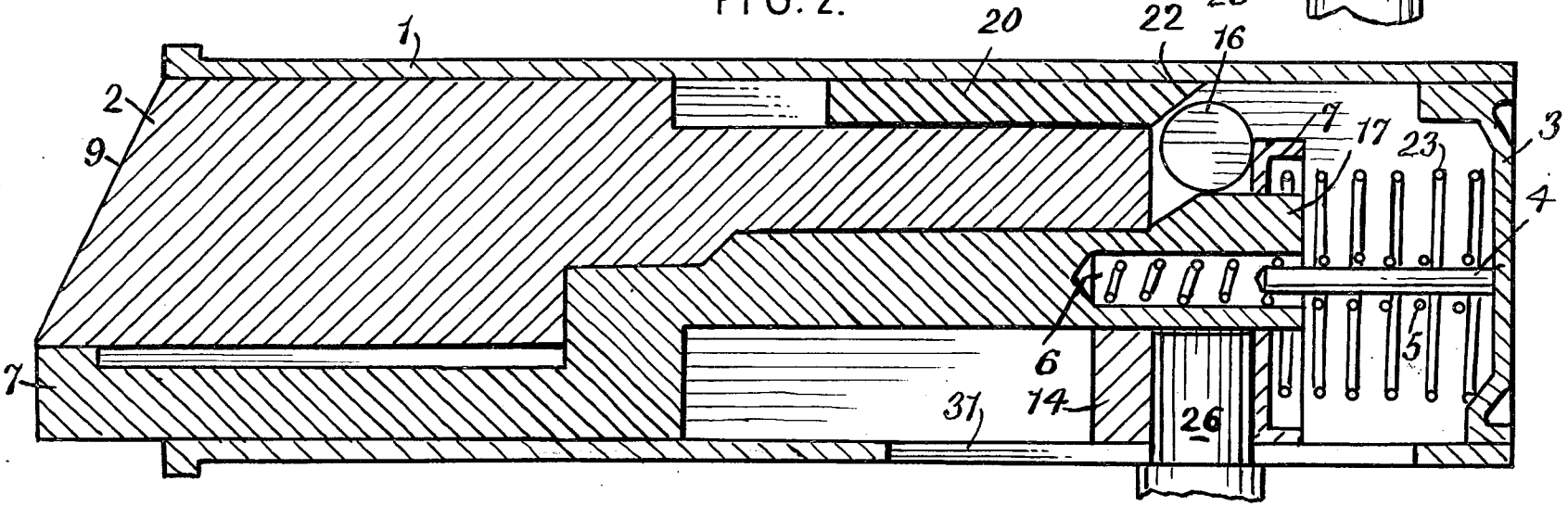
Figure 3:
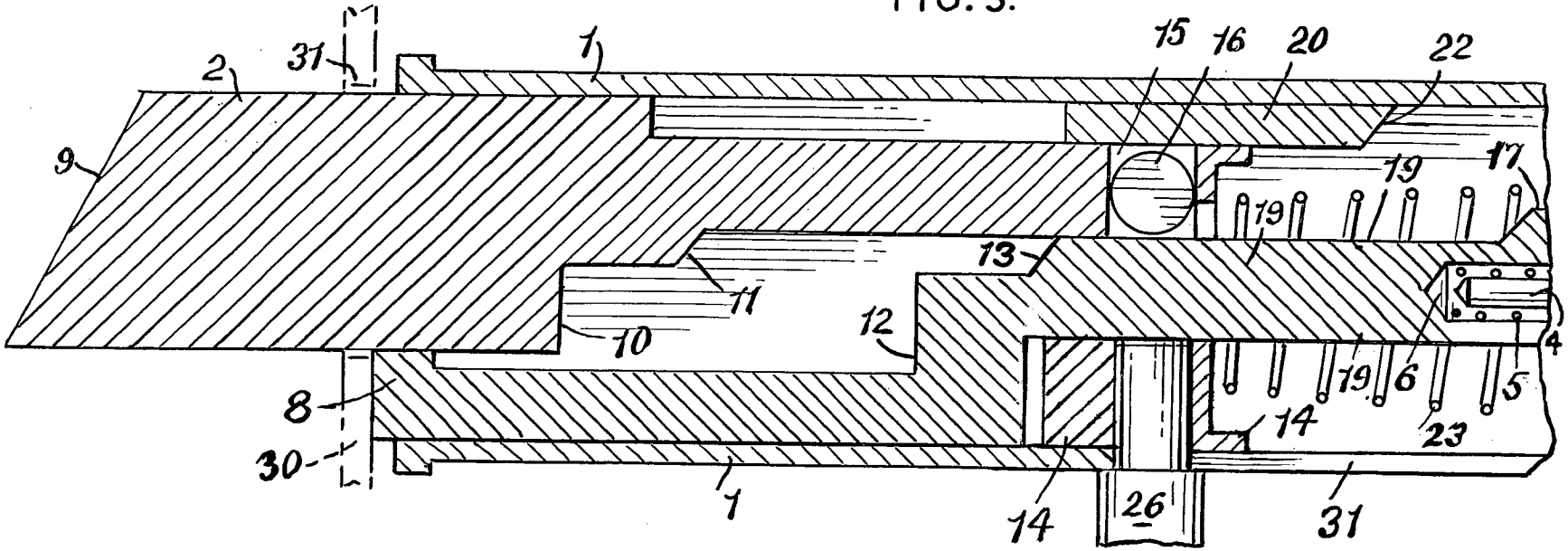

In the accompanying drawings, wherein an illustrative embodiment of the invention is disclosed, FIG. 1 is a longitudinal sectional view through a lock mechanism constructed according to the invention, with the bolt of the lock shown in its fully retracted position;

FIG. 2 is a similar view but showing the bolt in partially projected or latching position, and FIG. 3 is a similar view showing the bolt in its fully extended or so-called dead bolt position.

Referring to the drawings, 1 indicates a portion of that part of the lock casing that contains the elements of the lock forming the present invention.

A sliding bolt is indicated at 2, said bolt being shown fully retracted or in the so-called "open" position of the lock in FIG. 1. In FIG. 2 the bolt is shown partially projected or in its latching position.

In FIG. 3 the bolt is shown fully extended or in the bolted or dead bolt condition of the lock.

The casing 1 is closed at one end by a wall 3 provided with a projecting spindle 4 that extends into the interior of the casing 1 and is surrounded by a coil spring 5 which extends into a recess 6 formed in one end of a sensing bar 7. The casing has an outlet end 35 for the emergence of the bolt 2.

The sensing bar 7 is located alongside of and in sliding contact with the bolt 2 and has a sliding movement both in company with and also independently of the bolt. In the fully retracted position of the bolt as shown in FIG. 1, as well as in its latching position of FIG. 2, it will be noted that the sensing bar 7 extends co-extensively with the bolt. That is to say, that in the two above-mentioned positions of the bolt, the end 8 of the sensing bar 7 will be located at the end 9 of the bolt.

In the fully retracted bolt position of FIG. 1, the biasing spring 5 has been compressed by the retracting movement of the bolt. Shoulders 10 and 11 on the bolt abut against shoulders 12, 13 (FIG. 3) on the sensing bar 7 to bring the sensing bar to either of the two positions shown respectively in FIGS. 1 and 2.

Provided at one end of the bolt 2 is a head 14 formed with a circumferential groove 15 within which a roller 16 is loosely mounted and is freely rotatively mounted.

In the condition of the lock mechanism as shown in FIG. 1, the roller is confined between a cam 17 provided at one end of the sensing bar 7 and the wall of the casing 1. In FIG. 2 wherein both the bolt 2 and sensing bar 7 have been moved to partially advanced or latching position, the roller is similarly confined.

When the bolt 2 is moved to the fully advanced or bolting position of FIG. 3, it will be seen that the advancing movement of the bolt 2 has caused movement of the roller 16 away from the cam 17 on the sensing bar 7, so that the roller rests on and can roll on the surface of the part 19 of the sensing bar.

A fixed stop 20 is provided within the casing 1 on the wall thereof and it normally limits the advancement of the bolt 2 to the position shown in FIG. 2 until upon closure of the door on which the lock is fitted. When the door is closed or is slammed shut the end of the sensing bar will contact the striker plate 30 (FIG. 3) on the door frame, bringing the sensing bar toward the right and from the position of FIG. 2 substantially back to the position of FIGS. 1 and 3. When the bolt 2 becomes aligned with the opening 31 in the striker plate 30 and enters into said opening, the roller 16, being then in the lowered position and resting upon the part 19 of the sensing bar as shown in FIG. 3, and away from contact with the inclined end 22 of the stop 20, will permit the bolt to be advanced to its extended or dead bolt position by the urge of the coil spring 23 that is confined between the end wall 3 of the casing and the head 14 of the bolt 2. The head 14 is apertured to permit the cam-bearing and portion of the sensing bar to pass through it.

To manually retract the bolt there is provided a stem 26 movable in the slot 29 of the casing 1, which stem can be key-controlled by lock means of known character to enable the bolt to be advanced or retracted by key or knob operation.

The operation of the improved lock construction is substantially as follows:

The fully retracted or open position of the lock is shown in FIG. 1. There the bolt 2 is fully retracted; springs 5 and 23 are compressed and sensing bar 7 is in its retracted position extending co-extensively with the bolt 2.

When stem 26 is freed by key knob operation, so that it can slidably move in the slot 31, springs 23 and 5 respectively become operative to move the bolt 2 and the sensing bar 7 together into the latching position of FIG. 2. The advancing movement of the bolt is limited by contact of the roller 16 with the surface 22 on the stop 20. Advancing movement of the sensing bar 7 is limited by the contact of the shoulders 12 and 13 on the sensing bar with the co-operating shoulders 10 and 11 on the bolt.

When a door or other closure carrying the lock is closed or is slammed shut, an automatic bolting of the door is attained. During closure of the door the sensing bar 7 will come into contact with the striker plate 30 on the door frame and the sensing bar 7 will be pushed back from the position of FIG. 2 to the position of FIG. 3, bringing the cam 17 of the sensing bar away from the roller 16 so that the roller will drop down and will rest on the part 19 of the sensing bar and will clear the stop 20. This will free the bolt 2 from its coupling to the sensing bar so that the spring 23 can become effective to advance the bolt to the fully projected or dead bolt position of FIG. 3.

What I claim is:

1. A lock mechanism comprising, a casing having a bolt outlet, a spring-biased bolt mounted within the casing and capable of projection therefrom to either a partially advanced or fully advanced position, a sensing bar arranged alongside of and in slidable contact with the bolt, said sensing bar being adapted to extend co-extensively with the bolt while the bolt is in its partially advanced position, a roller carried by the bolt, a cam carried by the sensing bar and on which the roller rests while the bolt is in its fully retracted or partially advanced positions and while the sensing bar is co-extensive to the bolt, stop means for limiting movement of the roller while said roller rests on the cam, the bolt having a sliding movement relatively to the sensing bar to bring it into fully advanced position when sliding movement of the sensing bar is prevented by contact with a striker plate on a door frame.

2. A lock mechanism having a casing provided with a bolt outlet, a bolt slidably mounted in the casing for projection through the outlet, spring means for biasing the bolt toward the outlet, a spring-biased sensing bar slidably mounted in the casing and arranged alongside of and in slidable contact with the bolt, stop means in the casing, a roller carried by the bolt and capable of transverse movement relatively to the bolt, said roller being controlled as to its transverse movement by said sensing bar and cooperating with the stop means when in a first position to limit the projection of the bolt and sensing bar out of the casing and when in a second position to be free of said stop means, said sensing bar being held against its spring bias when it contacts with the striking plate on a door frame to thereby free the roller from restriction by the stop means, thereby permitting movement of the bolt under its spring bias to a dead bolt position.

3. A lock mechanism according to claim 2, wherein the bolt has a groove, the roller being carried in said groove, the roller riding upon a surface on the sensing bar, a cam on the sensing bar adjacent to one end of the sensing bar, the stop means and cam being effective to confine the roller between them while the bolt and sensing bar are in the first position in contiguous and co-extensive relation, the sensing bar being halted from advancing movement by contact with a striking plate on a door frame to permit the roller to move from between the cam and stop means and allow the bolt to be moved under its spring bias to an extended dead bolt position.

4. A lock mechanism comprising, a casing provided with a bolt outlet, a bolt slidably mounted in the casing and spring-biased toward the outlet, a spring-biased sensing bar located in the casing alongside of the bolt and movable in company therewith, stop means respectively mounted on the casing and on the sensing bar, a roller carried by the bolt and disposed between the stop means, the stop means on the sensing bar having a cam against which the roller rests at times to maintain the roller in one position to abut the stop means on the casing to limit the extent of projection of the bolt and sensing bar to latching position out of the casing, the bolt being capable of advancement out of the casing to a dead bolt position when the roller moves to a second position away from the cam and bypasses the stop means on the casing, this occurring when movement of the sensing bar out of the outlet by contact of the sensing bar with a striking plate on a door frame is prevented.

* * * * *